US008704814B2

(12) United States Patent
Yen

(10) Patent No.: US 8,704,814 B2
(45) Date of Patent: Apr. 22, 2014

(54) DRIVING DEVICE OF FLAT PANEL DISPLAY AND DRIVING METHOD THEREOF

(75) Inventor: Yu-Jen Yen, Tainan County (TW)

(73) Assignee: Himax Technologies Limited, Tainan (TW)

( * ) Notice: Subject to any disclaimer, the term of this patent is extended or adjusted under 35 U.S.C. 154(b) by 629 days.

(21) Appl. No.: 12/850,881

(22) Filed: Aug. 5, 2010

(65) Prior Publication Data

US 2012/0032935 A1 Feb. 9, 2012

(51) Int. Cl.
*G09G 5/00* (2006.01)

(52) U.S. Cl.
USPC ..... 345/211; 345/204

(58) Field of Classification Search
USPC ..... 345/87–104, 204–215, 690–699
See application file for complete search history.

(56) References Cited

U.S. PATENT DOCUMENTS

| | | | | |
|---|---|---|---|---|
| 6,961,054 | B2 * | 11/2005 | Matsumoto | 345/204 |
| 7,932,881 | B2 * | 4/2011 | Kageyama et al. | 345/78 |
| 8,022,910 | B2 * | 9/2011 | Kim et al. | 345/89 |
| 2005/0068286 | A1 * | 3/2005 | Morita | 345/100 |
| 2006/0267901 | A1 * | 11/2006 | Maekawa | 345/98 |
| 2010/0103152 | A1 * | 4/2010 | Tsai et al. | 345/208 |

* cited by examiner

*Primary Examiner* — Kashif Siddiqui
(74) *Attorney, Agent, or Firm* — J.C. Patents

(57) ABSTRACT

A driving device and a driving method of a flat panel display are provided. The driving device includes a driving circuit, an output buffer and a buffer control module. The driving circuit outputs a pixel data during a valid data period, and an input terminal of the output buffer receives the output of the driving circuit. The buffer control module turns off the output buffer during a blanking data period, and turns on the output buffer during the valid data period in order to reduce power consumption of the output buffer, and maintain an image quality of the flat panel display.

7 Claims, 7 Drawing Sheets

DRIVING DEVICE OF FLAT PANEL DISPLAY AND DRIVING METHOD THEREOF

BACKGROUND

1. Field of the Invention

The invention relates to a flat panel display. More particularly, the invention relates to a driving device of a flat panel display.

2. Description of Related Art

In today's society, various electronic products (for example, notebooks, mobile phones and televisions, etc.) are equipped with display devices to facilitate users checking device status and obtain information, etc. Since a flat panel display (FPD) has advantages of low power consumption, and small size, etc., it has replaced a conventional cathode ray tube (CRT). The flat panel displays are named according to shapes of their display panels, and include liquid crystal displays (LCDs), plasma display panels (PDP), organic light emitting displays (OLEDs) and field emission displays (FEDs), etc.

In various types of the flat panel displays, a plurality of scan (gate) signals and data (source) signals are used to display images. As a size and resolution of the flat panel display are increased, a load required to be driven when a driving device drives the display panel is increased, and a charge/discharge time thereof is relatively decreased. Therefore, when the driving device is designed, a driving capability of a driving signal of the driving device has to be considered, so as to satisfy requirements of a large-scaled display panel and increased resolution thereof.

However, when the driving device charges/discharges pixel capacitors of the display panel, an adequate driving capability is required only during a transition period (i.e. a period that the pixel is charged or discharged) of a pixel signal, so as to accelerate the charge/discharge time. In case that the pixel is in a stable period (i.e. a period that charge/discharge of the pixel is completed), or a blanking data period that updating of pixel data is not required, extra power is wasted in the driving device, which results in waste of energy.

SUMMARY

The invention is directed to a driving device of a flat panel display, the driving device turns off an output buffer during a blanking data period, and turns on the output buffer during a valid data period, so as to reduce a power consumption of the output buffer and meanwhile maintain a display quality of the flat panel display.

According to another aspect, the invention provides a driving method of a display panel, by which an output buffer is turned off during a blanking data period, and is turned on during a valid data period, so as to maintain a display quality while reducing a power consumption of the output buffer.

The invention provides a driving device of a flat panel display. The driving device includes a driving circuit, an output buffer, and a buffer control module. The driving circuit outputs a pixel data during a valid data period, and an input terminal of the output buffer receives the output of the driving circuit. The buffer control module turns off the output buffer during a blanking data period, and turns on the output buffer during the valid data period.

In an embodiment of the invention, the driving device further includes a timing controller used for generating a system clock signal, and the buffer control module samples a data enable signal according to the system clock signal, so as to determine the blanking data period and the valid data period.

In an embodiment of the invention, the driving device further includes a timing controller used for generating a vertical sync signal, and the buffer control module calculates the blanking data period and the valid data period according to the vertical sync signal, a front porch period and a back porch period.

In an embodiment of the invention, the buffer control module includes a buffer control unit and a first buffer switch unit. During the blanking data period, the buffer control unit sets a buffer switch signal to a first potential, and sets the buffer switch signal to a second potential during the valid data period. The first buffer switch unit is connected to the buffer control unit, and turns on or turns off the output buffer according to the first potential or the second potential of the buffer switch signal.

In an embodiment of the invention, the first buffer switch unit includes a first transistor, a first switch and a first current source. A first end of the first transistor receives a system voltage, and a control end of the first transistor is coupled to a second end of the first transistor to generate a first switch voltage. A first end of the first switch is coupled to the second end of the first transistor, a second end of the first switch is coupled to the system voltage, and a control end of the first switch receives the buffer switch signal. A supply end of the first current source is coupled to a third end of the first switch. When the buffer switch signal has the first potential, the first end and the second end of the first switch are conducted, so that the first switch voltage is equal to the system voltage, and when the buffer switch signal has the second potential, the first end and the third end of the first switch are conducted, so that the first switch voltage has a first normal bias value.

In an embodiment of the invention, the output buffer includes an operational amplifier and a first power switch. A non-inverting terminal of the operational amplifier serves as the input terminal of the output buffer, and an inverting terminal of the operational amplifier is coupled to an output terminal of the operational amplifier to serve as an output terminal of the output buffer. A control end of the first power switch receives the first switch voltage, a first end of the first power switch receives the system voltage, and a second end of the first power switch is coupled to a first power terminal of the operational amplifier. The first power switch turns on/off the operational amplifier according to the first switch voltage. In detail, when the first switch voltage is the system voltage, the first power switch turns off the operational amplifier, and when the first switch voltage is the first normal bias value, the first power switch turns on the operational amplifier.

In an embodiment of the invention, the buffer control module further includes a second buffer switch unit. The second buffer switch unit is coupled to the buffer control unit, and the second buffer switch unit turns on/off the output buffer according to the buffer switch signal.

In an embodiment of the invention, the second buffer switch unit includes a second transistor, a second switch and a second current source. A first end of the second transistor receives a ground voltage, and a control end of the second transistor is coupled to a second end of the second transistor to generate a second switch voltage. A first end of the second switch is coupled to the second end of the second transistor, a second end of the second switch is coupled to the ground voltage, and a control end of the second switch receives the buffer switch signal. A supply end of the second current source is coupled to a third end of the second switch. When the buffer switch signal has the first potential, the first end and the second end of the second switch are conducted, so that the second switch voltage is equal to the ground voltage, and when the buffer switch signal has the second potential, the first end and the third end of the second switch are conducted, so that the second switch voltage has a second normal bias value.

In an embodiment of the invention, the output buffer further includes a second power switch. A control end of the second power switch receives the second switch voltage, and a first end of the second power switch receives the ground voltage. A second end of the second power switch is coupled to a second power terminal of the operational amplifier, and the second power switch turns on/off the operational amplifier according to the second switch voltage. When the second switch voltage is the system voltage, the second power switch turns off the operational amplifier, and when the second switch voltage is the second normal bias value, the second power switch turns on the operational amplifier.

According to another aspect, the invention provides a driving method of a flat panel display. The method can be described as follows. A driving circuit outputs a pixel data during a valid data period, and an input terminal of an output buffer receives the output of the driving circuit. Moreover, the output buffer is turned off during a blanking data period, and is turned on during the valid data period.

In an embodiment of the invention, the driving method further includes a following step. A data enable signal is sampled according to a system clock signal, so as to determine the blanking data period and the valid data period.

In an embodiment of the invention, the driving method further includes a following step. The blanking data period and the valid data period are calculated according to a vertical sync signal, a front porch period and a back porch period.

According to the above descriptions, the valid data period and the blanking data period in the data enable signal can be determined through calculation or sampling operation performed according to the system clock signal or the vertical sync signal of the timing controller. During the blanking data period, the buffer control module turns off the output buffer to reduce a power consumption of the output buffer, and during the valid data period, the buffer control module turns on the output buffer to maintain a driving capability thereof, so as to normally drive the display panel to maintain a display quality of the flat panel display.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
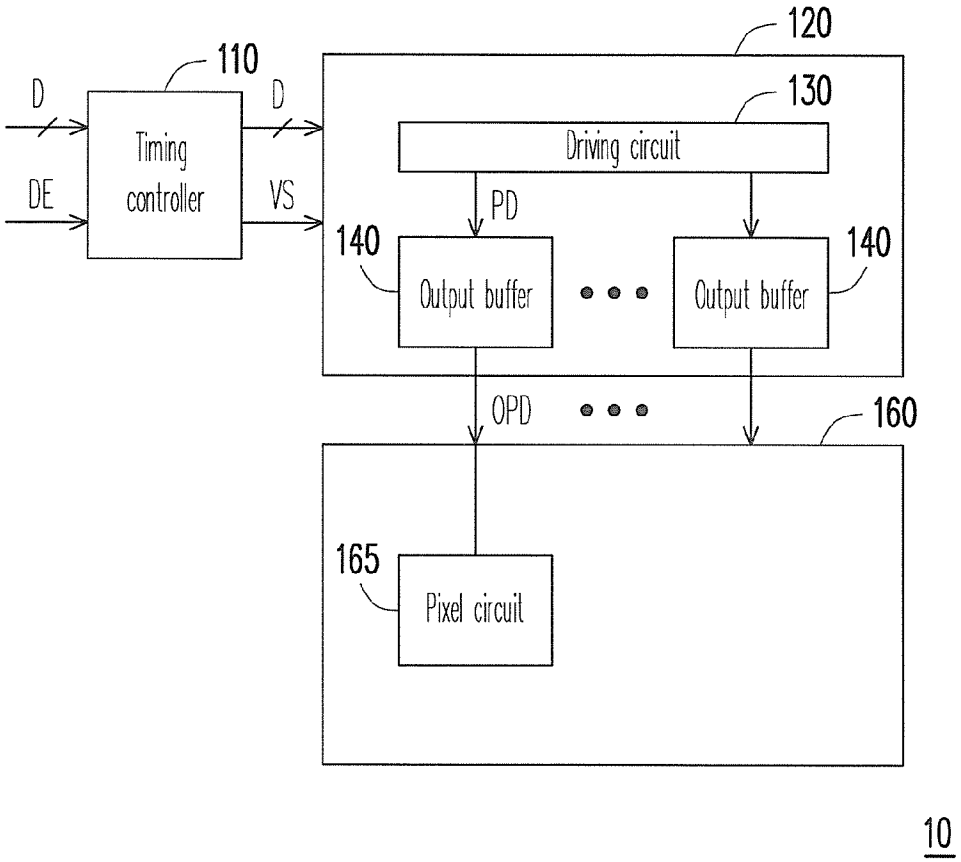
FIG. 1 is a block diagram of a flat panel display.

Reference will now be made in detail to the present preferred embodiments of the invention, examples of which are illustrated in the accompanying drawings. Wherever possible, the same reference numbers are used in the drawings and the description to refer to the same or like parts.

Figure 2:
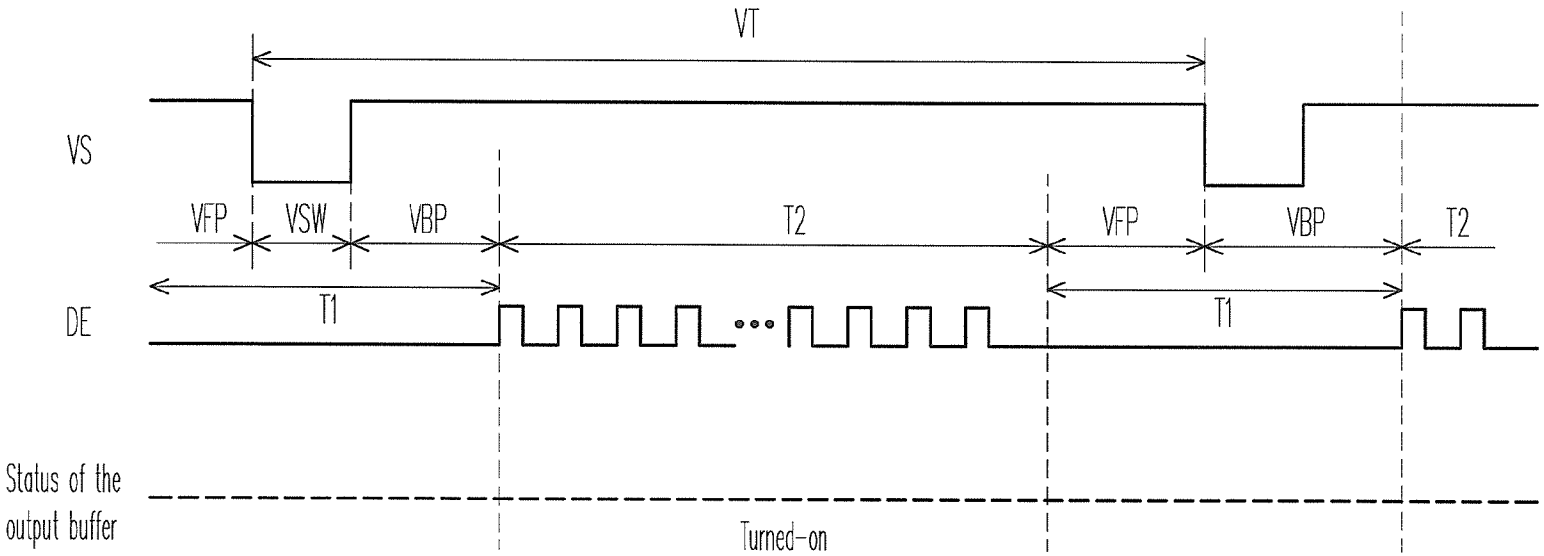
FIG. 2 is a waveform diagram of a vertical sync signal, a data enable signal and a bias of an output buffer.

At any time or status, each output buffer 140 of a flat panel display 10 is maintained to an enable state (or a turned-on state) to facilitate opportunely providing enough driving power to quickly charge/discharge a display panel 160, so that a source driver 120 may quickly update pixel data of a plurality of pixel circuits (for example, a pixel circuit 165), as that shown in FIG. 1 and FIG. 2. FIG. 1 is a block diagram of the flat panel display 10, and FIG. 2 is a waveform diagram of a vertical sync signal VS, a data enable signal DE and a bias of an output buffer 140. Referring to FIG. 1, the flat panel display 10 includes a timing controller 110, the source driver 120 and the display panel 160. The source driver 120 includes a driving circuit 130 and a plurality of output buffers 140, and a number of the output buffers 140 is determined according to a number of pixels contained in each scan line, and one output buffer 140 is taken as an example herein. Moreover, the pixel circuit 165 of the display panel 160 corresponding to the output buffer 140 is taken as an example for description.

In the present embodiment, the timing controller 110 receives a data signal D to be displayed on the display panel 160 and the data enable signal DE, and converts the received signals into a plurality of signals such as the vertical sync signal VS, etc., and provides these signals to devices such as the source driver 120 for utilization. The driving circuit 130 transmits a corresponding pixel data PD to the output buffer 140 according to the data signal D and the related signals transmitted by the timing controller 110. The output buffers 140 write the pixel data PD into the corresponding pixel circuit (for example, the pixel circuit 165) according to timing of scan lines. In the present embodiment, the output buffer 140 receives enough bias, so that the output buffer 140 is in a turned-on state all the time, and the output buffer 140 charges/discharges a pixel load (not shown) of the pixel circuit 165 according to the pixel data PD, so that the display panel 160 can display an image, and a detailed waveform flow thereof is as that shown in FIG. 2.

Referring to FIG. 2, a frame period VT of the vertical sync signal VS includes a switching period VSW, a back porch period VBP, a valid data period T2 and a front porch period (VFP). During the switching period VSW, the vertical sync signal VS notifies the driving circuit 130 that transmission of image signals of a previous frame is completed, and it is ready to transmit image signals of a next frame. In the present embodiment, a pulse oscillated between a high level and a low level is used to represent the switching period VSW. The back porch period VBP and the front porch period VFP represent a front and a back preparation time required by the flat panel display 10 when the image signals of a same frame are transmitted. The data signal D (not shown) and the data enable signal DE sequentially carry the image signals of the same frame during the valid data period T2 other than the back porch period VBP and the front porch period VFP of the vertical sync signal VS, and the timing controller 110 receives the data signal D according to the data enable signal DE, and transmits the data signal D to the driving circuit 130. The driving circuit 130 converts the digital-type data signal D into an analog-type pixel data PD, and transmits the pixel data PD to the output buffer 140. Moreover, in the present embodiment, the switching period VSW, the back porch period VBP and the front porch period VFP are all together referred to as a blanking data period T1. According to the data enable signal DE, it is known that the data signal D does not have valid data during the blanking data period T1. Namely, the driving circuit 130 does not provide valid pixel data PD to the output buffer 140 during the blanking data period T1.

In the example of FIG. 1 and FIG. 2, the output buffer 140 is in the turned-on state all the time during the frame period VT. During the valid data period T2, the output buffer 140 in the turned-on state can provide enough driving power to quickly transmit the pixel data PD to the pixel circuit 165. However, during the blanking data period T1, the pixel data PD is unnecessary to be updated or driven, so that extra power is wasted in the output buffer 140 having the enough driving power, which may cause waste of energy.

Figure 3:
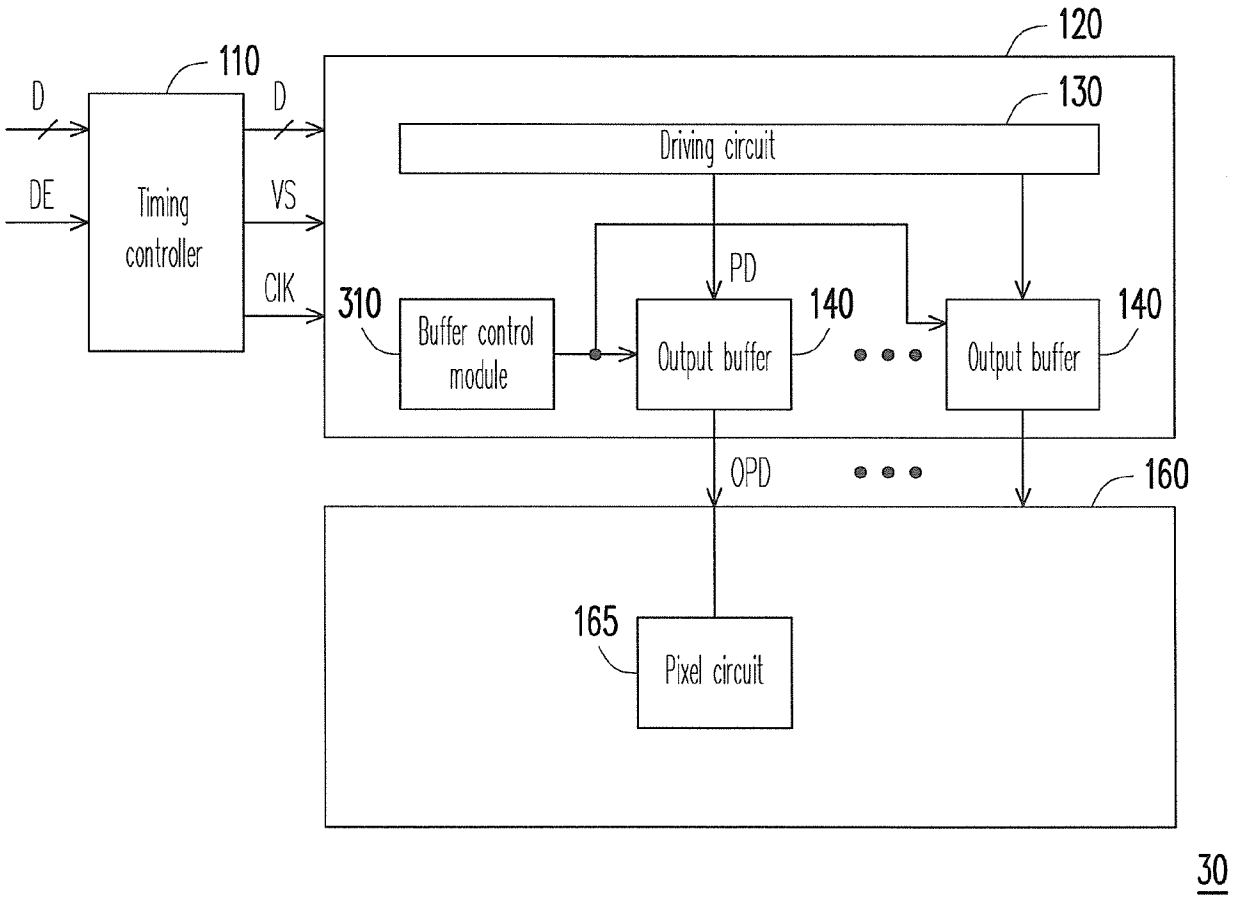
FIG. 3 is a block diagram illustrating a flat panel display according to a first embodiment of the invention.

Therefore, a buffer control module 310 complied with a first embodiment of the invention is used to turn off the output buffer 140 during the blanking data period T1, so as to save a power consumption, and during the valid data period T2, the buffer control module 310 turns on the output buffer 140 to maintain an image quality of the display panel 160, as that shown in FIG. 3. FIG. 3 is a block diagram illustrating a flat panel display according to a first embodiment of the invention. Referring to FIG. 3, the flat panel display 30 includes a timing controller 110, a source driver 120 and a display panel 160. The present embodiment is similar to the above embodiment, so that descriptions of the similar parts are not repeated.

In the present embodiment, the source driver 120 can define the switching period VSW, the back porch period VBP and the front porch period VFP according to the vertical sync signal VS provided by the timing controller 110. For example, the source driver 120 may use a counter (or a time counter) to define the back porch period VBP, the valid data period T2 and the front porch period VFP according to phases of the vertical sync signal VS. In other embodiments, the source driver 120 can define the valid data period T2 and the blanking data period T1 by detecting the data enable signal DE.

The source driver 120 (which can also be referred to as a driving device 120 in the present embodiment) includes the driving circuit 130, the output buffers 140 and the buffer control module 310. The driving circuit 130 outputs the pixel data PD during the valid data period T2. An input terminal of the output buffer 140 receives the output of the driving circuit 130, and an output terminal of the output buffer 140 drives the display panel 160. The buffer control module 310 can calculate or determine the blanking data period T1 and the valid data period T2 in the frame period VT according to the vertical sync signal VS or the data enable signal DE provided by the timing controller 110, and during the blanking data period T1, the buffer control module 310 turns off (or disables) the output buffer 140, and turns on (or enables) the output buffer 140 during the valid data period T2.

In other embodiments, the devices in the flat panel display 30 other than the display panel 160 can all be regarded as the driving device. Moreover, besides being disposed in the source driver 120, in other embodiments, the buffer control module 310 can also be disposed in the timing controller 110. In other words, disposing position of the buffer control module 310 in the flat panel display 30 can be determined according to an actual design requirement, which is unnecessary to be embedded in the source driver 120, and the invention is not limited thereto.

Figure 4:
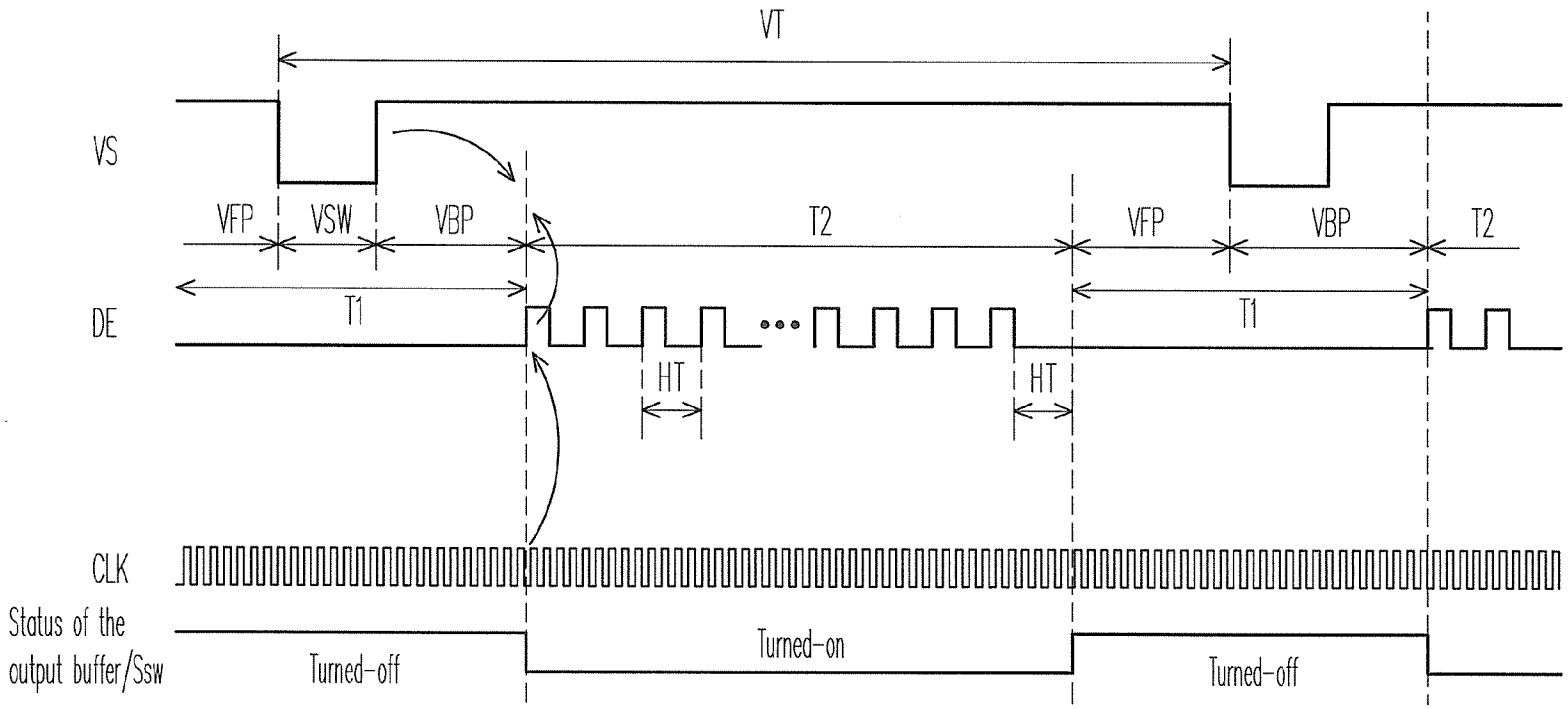
FIG. 4 is a waveform diagram of a vertical sync signal, a data enable signal and a bias of an output buffer according to a first embodiment of the invention.

An operation method and principle of the buffer control module 310 are described in detail below with reference of FIG. 4. FIG. 4 is a waveform diagram of the vertical sync signal VS, the data enable signal DE and a bias of the output buffer 140 according to the first embodiment of the invention. It should be noticed that the data enable signal DE of FIG. 4 carries the image signals of a same frame during one valid data period T2, and each frame is formed by pixel data of a plurality of scan lines, so that a horizontal scan time period HT of FIG. 4 represents a time required for updating pixel data of each scan line in the frame. An example is provided below for detailed description. Assuming a frame of the present embodiment has 1024×768 pixels, i.e. each frame has 768 scan lines, and each scan line has 1024 pixels, so that the valid data period T2 consists of 768 horizontal scan time period HT.

Moreover, the buffer control module 310 can determine the blanking data period T1 and the valid data period T2 according to a design requirement and a plurality of signals (for example, a system clock signal CLK, the vertical sync signal VS and the data enable signal DE, etc.) of the timing controller 110, though the invention is not limited thereto. Referring to FIG. 3 and FIG. 4, in the present embodiment, the buffer control module 310 can determine the blanking data period T1 and the valid data period T2 according to the data enable signal DE, so as to turn on/off the output buffer 140. In detail, the buffer control module 310 samples the data enable signal DE according to each pulse of the system clock signal CLK, and when a sampling result shows that the data enable signal DE is in a high level, i.e. at a time when the driving circuit 130 is updating the pixel data PD according to the data signal D, the buffer control module 310 immediately turns on the output buffer 140, so as to transmit the pixel data PD to the display panel 160. When a sampling result shows that the data enable signal DE is in a low level, and such sampling results corresponding to the low level lasts for at least one horizontal scan time period HT, it represents that the valid data period T2 is ended, i.e. the front porch period VFP/the blanking data period T1 is started, so that the buffer control module 310 turns off the output buffer 140 to save the power consumption.

In another embodiment, the buffer control module 310 can also calculate and determine the blanking data period T1 and the valid data period T2 according to the vertical sync signal VS, so as to turn on/off the output buffer 140. In detail, the buffer control module 310 calculates when the back porch period VBP/the blanking data period T1 is ended for entering the valid data period T2 according to phases of a pulse (i.e. the switching period VSW) of the vertical sync signal VS and the system clock signal CLK, so as to switch the output buffer 140 from the turned-off state to the turned-on state, and accordingly maintain the image quality of the display panel. Moreover, the buffer control module 310 can also calculate a time length of the valid data period T2 (768 horizontal scan time period HT in the present embodiment) according to the clock signal CLK, so as to switch the output buffer 140 from the turned-on state to the turned-off state, and accordingly reduce the power consumption.

Figure 5:
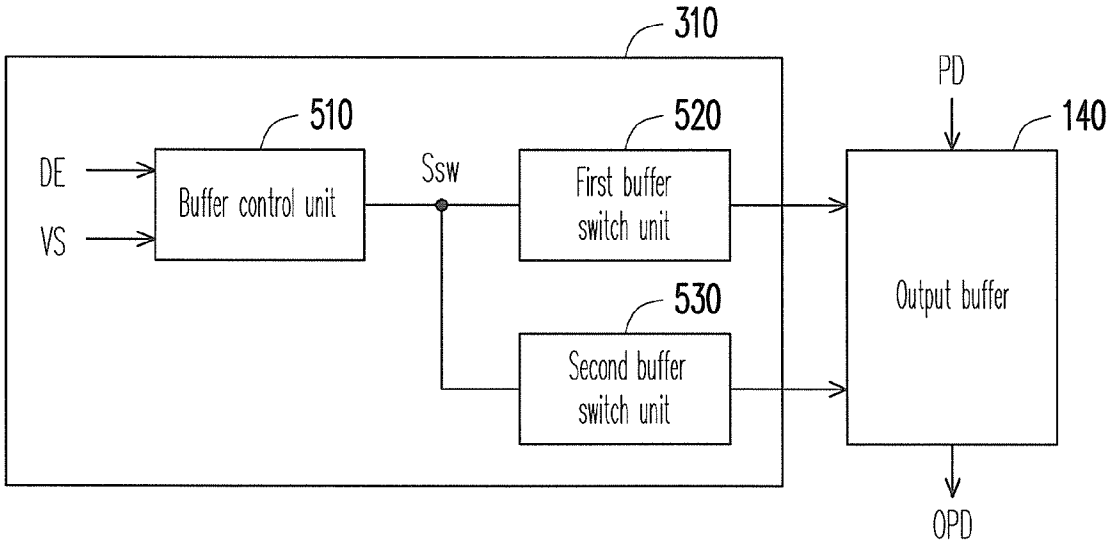
FIG. 5 is a block diagram illustrating a buffer control module according to a first embodiment of the invention.

As shown in FIG. 5, FIG. 5 is a block diagram illustrating a buffer control module 310 according to the first embodiment of the invention. Referring to FIG. 5, the buffer control module 310 includes a buffer control unit 510 and a first buffer switch unit 520. The buffer control unit 510 determines the blanking data period T1 and the valid data period T2 according to the data enable signal DE or the vertical sync signal VS. During the blanking data period T1, the buffer control unit 510 sets a buffer switch signal Ssw (shown in FIG. 4) to a first potential (for example, a high potential), and during the valid data period T2, the buffer control unit 510 sets the buffer switch signal Ssw to a second potential (for example, a low potential).

Referring to FIG. 5 again, the first buffer switch unit 520 is connected to the buffer control unit 510, and turns off/on the output buffer 140 according to the high potential or the low potential of the buffer switch signal Ssw. Moreover, in the present embodiment, the buffer control module 310 may further include a second buffer switch unit 530, which is connected to the buffer control unit 510. The second buffer switch unit 530 turns on/off the output buffer 140 according to the high potential or the low potential of the buffer switch signal Ssw. In detail, when the buffer switch signal Ssw has the high potential, the first buffer switch unit 520 and the second buffer switch unit 530 control the output buffer 140 to be in the turned-off state, and when the buffer switch signal Ssw has the low potential, the first buffer switch unit 520 and the second buffer switch unit 530 control the output buffer 140 to be in the turned-on state.

The buffer control unit 510 can calculate and generate the buffer switch signal Ssw according to the data enable signal DE or the vertical sync signal VS through a plurality of approaches, so that the first buffer switch unit 520 and the second buffer switch unit 530 can turn on/off the output buffer 140 according to the buffer switch signal Ssw. For example, the buffer control unit 510 can be implemented by a field-programmable gate array (FPGA), a complex programmable logic device (CPLD), a phase locked loop (PLL, a microchip, an application specific integrated circuit (ASIC), etc., though the invention is not limited to the above implementations.

Figure 6:
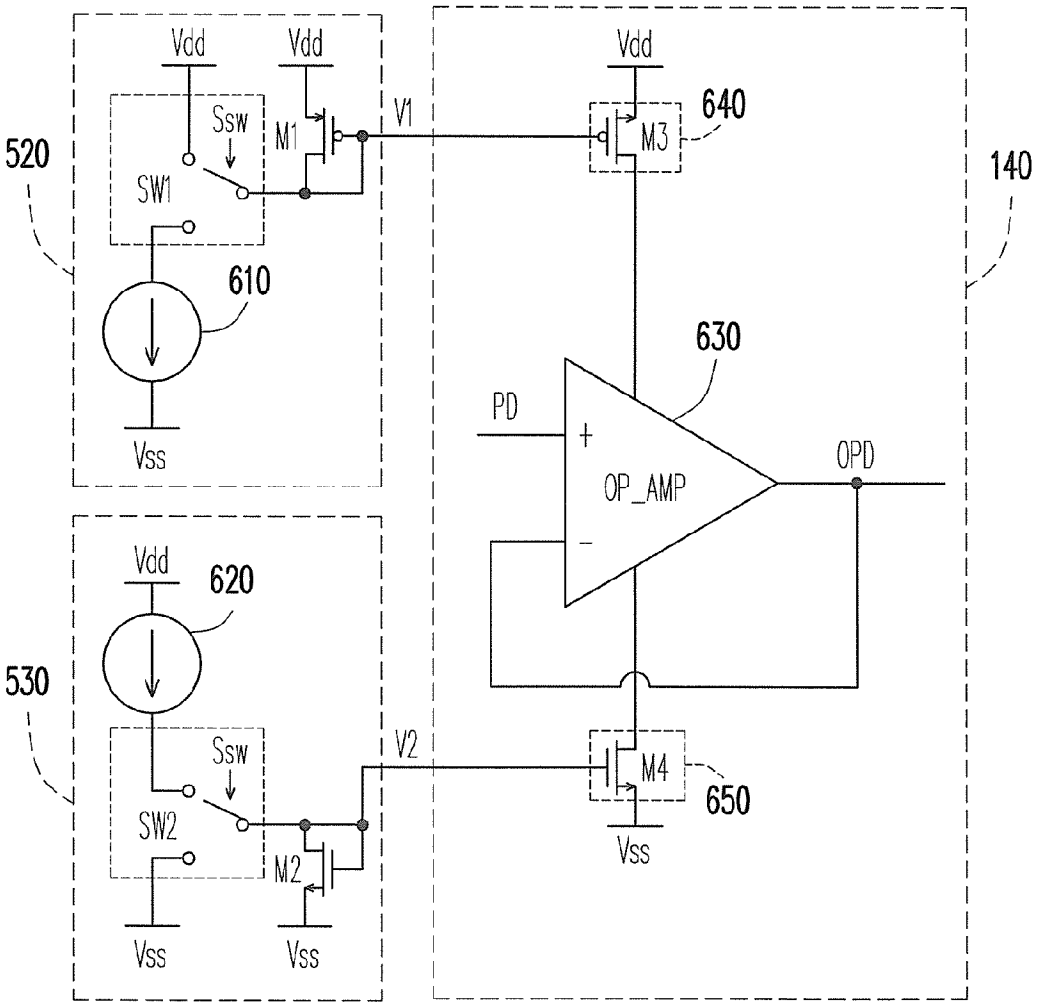
FIG. 6 is a circuit diagram illustrating a buffer control module according to a first embodiment of the invention.

Detailed circuit structures of the first buffer switch unit 520, the second buffer switch unit 530 and the output buffer 140 of the present embodiment are described below with reference of FIG. 6. FIG. 6 is a circuit diagram illustrating the buffer control module 310 according to the first embodiment of the invention. Referring to FIG. 6, the first buffer switch unit 520 includes a first transistor M1, a first switch SW1 and a first current source 610. In the present embodiment, the first transistor M1 can be implemented by a P-channel metal oxide semiconductor field-effect transistor (P-MOSFET) (which is also referred to as a P-channel transistor). A first end (for example, a source) of the first transistor M1 receives a system voltage Vdd, and a control end (for example, a gate) of the first transistor M1 is coupled to a second end (for example, a drain) of the first transistor M1 to generate a first switch voltage V1. A first end of the first switch SW1 is coupled to the drain of the first transistor M1, a second end of the first switch SW1 is coupled to the system voltage Vdd, and a control end of the first switch SW1 receives the buffer switch signal Ssw. Moreover, a supply end of the first current source 610 is coupled to a third end of the first switch SW1, and another end of the first current source 610 is coupled to a ground voltage Vss.

The second buffer switch unit 530 includes a second transistor M2, a second switch SW2 and a second current source 620. In the present embodiment, the second transistor M2 can be implemented by an N-channel metal oxide semiconductor field-effect transistor (N-MOSFET) (which is also referred to as an N-channel transistor). A first end (for example, a source) of the second transistor M2 receives the ground voltage Vss, and a control end (for example, a gate) of the second transistor M2 is coupled to a second end (for example, a drain) of the second transistor M2 to generate a second switch voltage V2. A first end of the second switch SW2 is coupled to the second end of the second transistor M2, a second end of the second switch SW2 is coupled to the ground voltage Vss, and a control end of the second switch SW2 receives the buffer switch signal Ssw. Moreover, a supply end of the second current source 620 is coupled to a third end of the second switch SW2, and another end of the second current source 620 is coupled to the system voltage Vdd.

The output buffer 140 includes an operational amplifier (OP-AMP) 630, a first power switch 640 and a second power switch 650. A non-inverting terminal of the operational amplifier 630 serves as the input terminal of the output buffer 140 for receiving the pixel data PD. An inverting terminal of the operational amplifier 630 is coupled to an output terminal of the operational amplifier 630. The output terminal of the operational amplifier 630 serves as the output terminal of the output buffer 140 for outputting the pixel data OPD to the display panel 160. The first power switch 640 is, for example, a P-channel transistor M3. A control end (for example, a gate) of the first power switch 640 receives the first switch voltage V1. A first end (for example, a source of the transistor M3) of the first power switch 640 receives the system voltage Vdd, and a second end (for example, a drain of the transistor M3) of the first power switch 640 is coupled to the first power terminal of the operational amplifier 630. The second power switch 650 is, for example, an N-channel transistor M4. A control end (for example, a gate) of the second power switch 650 receives the second switch voltage V2. A first end (a source of the transistor M4) of the second power switch 650 receives the ground voltage Vss, and a second end (a drain of the transistor M4) of the second power switch 650 is coupled to the second power terminal of the operational amplifier 630. The first power terminal and the second power terminal are used for supplying power to the operational amplifier 630.

In this way, when the buffer switch signal Ssw has the high potential (i.e. the first potential), the first end and the second end of each of the first switch SW1 and the second switch SW2 are conducted, so that the first switch voltage V1 is equal to the system voltage Vdd, and the second switch voltage V2 is equal to the ground voltage Vss. Now, the first power switch 640 and the second power switch 650 are turned off, and cannot provide power to the operational amplifier 630, so that the operational amplifier 630 is in the turned-off state. Comparatively, when the buffer switch signal Ssw has the low potential (i.e. the second potential), the first end and the third end of each of the first switch SW1 and the second switch SW2 are conducted, namely, the transistors M1 and M2 are respectively connected to the current sources 610 and 620, so that the first switch voltage V1 and the second switch voltage V2 respectively have a first normal bias value and a second normal bias value. Now, the first power switch 640 and the second power switch 650 can provide enough power to the operational amplifier 630, so that the operational amplifier 630 is in the turned-on state.

Figure 7:
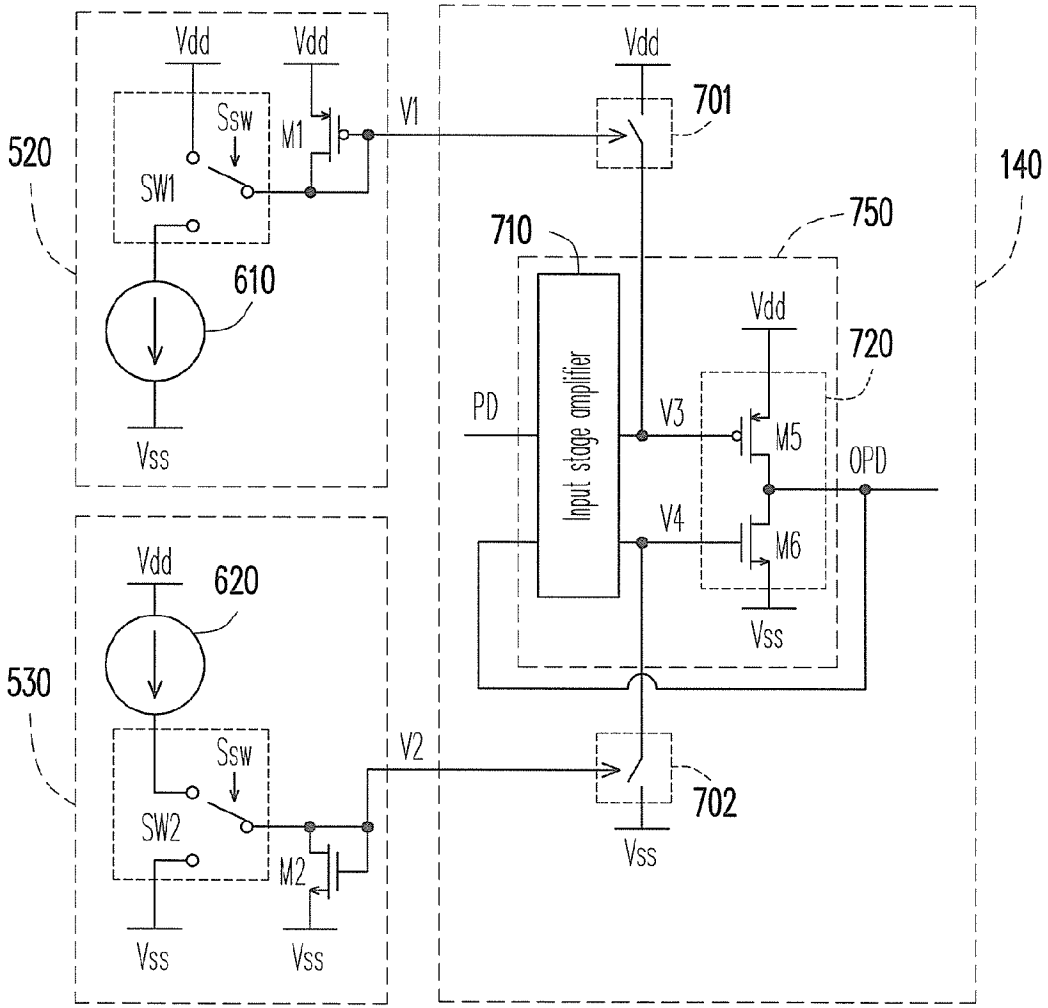
FIG. 7 is a circuit diagram illustrating a buffer control module according to a second embodiment of the invention.

A second embodiment of the invention is provided below with reference of FIG. 7. FIG. 7 is a circuit diagram illustrating a buffer control module according to a second embodiment of the invention. Referring to FIG. 7, the present embodiment is similar to the first embodiment of FIG. 6, so that descriptions of the similar parts are not repeated. A difference there between is that the operational amplifier 630 of FIG. 6 is turned on/off by directly turning on/off the power, though in the operational amplifier 750 of FIG. 7, signals transmitted in the operational amplifier 750 are directly pulled high/low to the system voltage Vdd/the ground voltage Vss, so as to turn on/off the operational amplifier 750.

In detail, the output buffer 140 of the present embodiment includes a first power switch 701, a second power switch 702 and an operational amplifier 750, wherein the operational amplifier 750 includes an input stage amplifier 710 and an output stage amplifier 720. In the present embodiment, the input stage amplifier 710 is, for example, a rail-to-rail amplifier, and the output stage amplifier 720 is, for example, a push-pull amplifier, though other types of input stage/output stage amplifiers can also be used, which is not limited by the invention. A non-inverting terminal and an inverting terminal of the operational amplifier 750 respectively transmit the pixel data PD and the pixel data OPD to the input stage amplifier 710. The input stage amplifier 710 receives the pixel data PD and OPD, and accordingly generates a voltage V3 and a voltage V4. In the output stage amplifier 720, a P-channel transistor M5 and an N-channel transistor M6 form a push-pull amplifier, wherein a control end (for example, a gate) of the transistor M5 receives a voltage V3, a source of the transistor M5 receives the system voltage Vdd, and a drain of the transistor M5 serves as an output terminal of the operational amplifier 750. Moreover, a control end (for example, a gate) of the transistor M6 receives the voltage V4, a source of the transistor M6 receives the ground voltage Vss, and a drain of the transistor M6 serves as the output terminal of the operational amplifier 750, and is coupled to the drain of the transistor M5.

In this way, when the buffer switch signal Ssw has the high potential (i.e. the first potential), the first power switch 701 and the second power switch 702 are conducted, so that the voltage V3 and the voltage V4 are forced to be the system voltage Vdd and the ground voltage Vsss, so as to turn off the operational amplifier 750. Comparatively, when the buffer switch signal Ssw has the low potential (i.e. the second potential), the first power switch 701 and the second power switch 702 are turned off, so that pixel data contained in the voltage V3 and the voltage V4 can be transmitted to the output stage amplifier 720, so as to turn on the operational amplifier 750.

In summary, the valid data period and the blanking data period in the data enable signal can be determined through calculation or sampling operation performed according to the system clock signal or the vertical sync signal of the timing controller. During the blanking data period, the buffer control module turns off the output buffer to reduce a power consumption of the output buffer, and during the valid data period, the buffer control module turns on the output buffer to maintain a driving capability thereof, so as to normally drive the display panel to maintain a display quality of the flat panel display. In this way, the display quality of the flat panel display of the invention is maintained, and meanwhile the power consumption thereof is reduced.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A driving device of a flat panel display, comprising:

a driving circuit, outputting a pixel data during a valid data period;

an output buffer, having an input terminal receiving the output of the driving circuit, and an output terminal driving a display panel; and a buffer control module, turning off the output buffer during a blanking data period, and turning on the output buffer during the valid data period, wherein the buffer control module comprises:

a buffer control unit, for setting a buffer switch signal to a first potential during the blanking data period, and setting the buffer switch signal to a second potential during the valid data period; and a first buffer switch unit, connected to the buffer control unit, for turning on or turning off the output buffer according to the first potential or the second potential of the buffer switch signal, wherein the first buffer switch unit comprises:

a first transistor, having a first end receiving a system voltage, a second end, and a control end coupled to the second end of the first transistor to generate a first switch voltage;

a first switch, having a first end coupled to the second end of the first transistor, a second end coupled to the system voltage, and a control end receiving the buffer switch signal; and a first current source, having a supply end coupled to a third end of the first switch, wherein the first end and the second end of the first switch are conducted when the buffer switch signal has the first potential, and the first end and the third end of the first switch are conducted when the buffer switch signal has the second potential.

2. The driving device of the flat panel display as claimed in claim 1, further comprising:

a timing controller, for generating a system clock signal, wherein the buffer control module samples a data enable signal according to the system clock signal, so as to determine the blanking data period and the valid data period.

3. The driving device of the flat panel display as claimed in claim 1, further comprising:

a timing controller, for generating a vertical sync signal, wherein the buffer control module calculates the blanking data period and the valid data period according to the vertical sync signal, a front porch period and a back porch period.

4. The driving device of the flat panel display as claimed in claim 1, wherein the output buffer comprises:

an operational amplifier, having a non-inverting terminal serving as the input terminal of the output buffer, and an inverting terminal coupled to an output terminal of the operational amplifier, wherein the output terminal of the operational amplifier serves as the output terminal of the output buffer; and a first power switch, having a control end receiving the first switch voltage, a first end receiving the system voltage, and a second end coupled to a first power terminal of the operational amplifier, wherein the first power terminal supply power to the operational amplifier.

5. The driving device of the flat panel display as claimed in claim 1, wherein the buffer control module further comprises:

a second buffer switch unit, coupled to the buffer control unit, for turning on/off the output buffer according to the buffer switch signal.

6. The driving device of the flat panel display as claimed in claim 5, wherein the second buffer switch unit comprises:

a second transistor, having a first end receiving a ground voltage, a second end, and a control end coupled to the second end of the second transistor to generate a second switch voltage;

a second switch, having a first end coupled to the second end of the second transistor, a second end coupled to the ground voltage, and a control end receiving the buffer switch signal; and a second current source, having a supply end coupled to a third end of the second switch, wherein the first end and the second end of the second switch are conducted when the buffer switch signal has the first potential, and the first end and the third end of the second switch are conducted when the buffer switch signal has the second potential.

7. The driving device of the flat panel display as claimed in claim 6, wherein the output buffer comprises:

an operational amplifier, having a non-inverting terminal serving as the input terminal of the output buffer, and an inverting terminal coupled to an output terminal of the operational amplifier, wherein the output terminal of the operational amplifier serves as the output terminal of the output buffer; and a second power switch, having a control end receiving the second switch voltage, a first end receiving the ground voltage, and a second end coupled to a second power terminal of the operational amplifier.

* * * * *